US008381872B2

(12) United States Patent
Alexander et al.

(10) Patent No.: US 8,381,872 B2
(45) Date of Patent: Feb. 26, 2013

(54) ACOUSTIC COMPOSITE

(75) Inventors: Jonathan H. Alexander, Roseville, MN (US); David F. Slama, Grant, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 165 days.

(21) Appl. No.: 12/991,166

(22) PCT Filed: May 5, 2009

(86) PCT No.: PCT/US2009/042824

§ 371 (c)(1), (2), (4) Date: Nov. 5, 2010

(87) PCT Pub. No.: WO2009/137466

PCT Pub. Date: Nov. 12, 2009

(65) Prior Publication Data

US 2011/0048850 A1 Mar. 3, 2011

Related U.S. Application Data

(60) Provisional application No. 61/050,526, filed on May 5, 2008.

(51) Int. Cl.

| | |
|---|---|
| ***E04B 1/82*** | (2006.01) |
| ***G10K 11/16*** | (2006.01) |
| *E04B 1/74* | (2006.01) |
| *G10K 11/00* | (2006.01) |

(52) U.S. Cl. ..... 181/296; 181/293; 181/286; 52/144; 52/145

(58) Field of Classification Search ..... 181/296, 181/290, 292, 293, 291, 284, 288, 286; 428/304.4, 428/137, 132, 133, 95, 34.1; 52/144, 145
See application file for complete search history.

(56) References Cited

U.S. PATENT DOCUMENTS

| | | | | | |
|---|---|---|---|---|---|
| 1,961,374 | A | * | 6/1934 | Mazer | 181/292 |
| 2,573,482 | A | * | 10/1951 | Peik | 181/284 |
| 2,840,179 | A | * | 6/1958 | Junger | 181/286 |
| 2,923,372 | A | * | 2/1960 | Maccaferri | 181/284 |
| 2,984,312 | A | * | 5/1961 | Gambill et al. | 181/292 |
| 3,026,224 | A | * | 3/1962 | Rogers, Jr | 428/167 |
| 3,174,580 | A | * | 3/1965 | Schulz et al. | 181/290 |
| 3,231,454 | A | * | 1/1966 | Williams | 428/132 |
| 3,597,891 | A | * | 8/1971 | Martin | 52/145 |
| 3,649,430 | A | * | 3/1972 | Lewis et al. | 428/138 |
| 3,656,576 | A | * | 4/1972 | Gubela | 181/210 |
| 3,804,196 | A | * | 4/1974 | Horn et al. | 181/285 |
| 3,819,007 | A | * | 6/1974 | Wirt et al. | 181/286 |
| 3,887,031 | A | * | 6/1975 | Wirt | 181/286 |
| 4,011,703 | A | * | 3/1977 | Tanzilli | 52/783.16 |
| 4,106,587 | A | * | 8/1978 | Nash et al. | 181/213 |
| 4,170,674 | A | * | 10/1979 | Matsuki | 428/90 |
| 4,231,447 | A | * | 11/1980 | Chapman | 181/213 |

(Continued)

FOREIGN PATENT DOCUMENTS

| | | |
|---|---|---|
| EP | 0 214 524 | 3/1987 |
| JP | 52-4615 | 1/1977 |

(Continued)

*Primary Examiner* — Edgardo San Martin
(74) *Attorney, Agent, or Firm* — Lisa P. Fulton; James A. Baker

(57) ABSTRACT

An acoustic composite comprises a flow resistive substrate having a solid acoustic barrier material bonded to at least a portion of a major surface of the flow resistive substrate; wherein the acoustic barrier material has a density greater than about 1 g/cm3 and the acoustic composite has a porosity between about 0.002% and about 50%.

20 Claims, 9 Drawing Sheets

U.S. PATENT DOCUMENTS

| | | | | |
|---|---|---|---|---|
| 4,355,489 | A | 10/1982 | Heyer et al. | |
| 4,486,200 | A | 12/1984 | Heyer et al. | |
| 4,533,583 | A * | 8/1985 | May | 428/69 |
| 4,555,433 | A | 11/1985 | Jablonka et al. | |
| 4,607,466 | A * | 8/1986 | Allred | 52/144 |
| 4,631,221 | A * | 12/1986 | Disselbeck et al. | 428/166 |
| 4,803,112 | A * | 2/1989 | Kakimoto et al. | 428/161 |
| 4,930,266 | A | 6/1990 | Calhoun et al. | |
| 5,004,070 | A * | 4/1991 | Wang | 181/286 |
| 5,180,620 | A * | 1/1993 | Mende | 428/138 |
| 5,233,767 | A * | 8/1993 | Kramer | 36/28 |
| 5,445,861 | A * | 8/1995 | Newton et al. | 428/116 |
| 5,512,715 | A * | 4/1996 | Takewa et al. | 181/295 |
| 5,554,830 | A * | 9/1996 | Muller et al. | 181/290 |
| 6,082,489 | A * | 7/2000 | Iwao et al. | 181/286 |
| 6,213,252 | B1 | 4/2001 | Ducharme | |
| 6,617,002 | B2 * | 9/2003 | Wood | 428/131 |
| 6,627,791 | B1 * | 9/2003 | Veglio et al. | 604/383 |
| 6,720,069 | B1 * | 4/2004 | Murakami et al. | 428/319.3 |
| 6,786,013 | B2 * | 9/2004 | Coulton | 52/198 |
| 6,789,646 | B2 * | 9/2004 | Wang et al. | 181/293 |
| 6,977,109 | B1 | 12/2005 | Wood | |
| 7,059,089 | B1 | 6/2006 | Fontaine | |
| 7,182,994 | B1 * | 2/2007 | Scott | 428/131 |
| 7,279,214 | B2 * | 10/2007 | Nicolai et al. | 428/137 |
| 7,308,965 | B2 * | 12/2007 | Sapoval et al. | 181/210 |
| 7,413,053 | B2 * | 8/2008 | Wasif et al. | 181/293 |
| 7,467,498 | B2 | 12/2008 | Fontaine | |
| 7,721,846 | B2 * | 5/2010 | Swift et al. | 181/293 |
| 7,886,488 | B2 * | 2/2011 | Payne et al. | 52/144 |
| 8,109,361 | B2 * | 2/2012 | Tsugihashi et al. | 181/207 |
| 2003/0006092 | A1 * | 1/2003 | D'Antonio et al. | 181/293 |
| 2004/0037995 | A1 * | 2/2004 | Nicolai et al. | 428/95 |
| 2004/0134098 | A1 * | 7/2004 | Beck | 36/44 |
| 2005/0186392 | A1 | 8/2005 | Fontaine | |
| 2005/0188633 | A1 | 9/2005 | Fontaine | |
| 2005/0241877 | A1 * | 11/2005 | Czerny et al. | 181/293 |
| 2005/0284690 | A1 * | 12/2005 | Proscia et al. | 181/214 |
| 2009/0108504 | A1 * | 4/2009 | Slama et al. | 264/528 |
| 2009/0233045 | A1 * | 9/2009 | Slama et al. | 428/131 |
| 2009/0297767 | A1 | 12/2009 | Fontaine | |
| 2010/0307866 | A1 * | 12/2010 | Zickmantel | 181/286 |

FOREIGN PATENT DOCUMENTS

| | | | |
|---|---|---|---|
| JP | 11348163 | A * | 12/1999 |
| JP | 2001249665 | A * | 9/2001 |
| WO | 2007/127890 | | 11/2007 |

* cited by examiner

ACOUSTIC COMPOSITE

CROSS REFERENCE TO RELATED APPLICATIONS

This application is a national stage filing under 35 U.S.C. 371 of PCT/US2009/042824, filed May 5, 2009, which claims the benefit of U.S. Provisional Patent Application No. 61/050,526 filed May 5, 2008, the disclosure of which is incorporated by reference in their entirety.

FIELD

This invention relates to acoustic composites and to methods of using acoustic composites for providing acoustic absorption and transmission loss.

BACKGROUND

Sound absorbers have been widely used in a number of different applications for absorbing sound. Known sound absorbers include, for example, fiber-based sound absorbers (for example, sound absorbers comprising fiberglass, open-cell polymeric foams, or fibrous materials) and perforated sheets. Microperforated films, for example, can function in the medium to high frequency absorption ranges with relatively good performance in the 800 Hz range and up.

Most sound absorbers, however, do not handle transmission loss well. Relatively low frequency transmission loss is therefore typically controlled using lots of mass (for example, steel plates, lead, concrete, or gypsum board).

SUMMARY

In view of the foregoing, we recognize that there is a need in the art for acoustic solutions that can provide both acoustic absorption and transmission loss, yet are relatively light in weight.

Briefly, the present invention provides an acoustic composite comprising a flow resistive substrate having a solid acoustic barrier material bonded to at least a portion of a major surface of the flow resistive substrate, wherein the acoustic barrier material has a density greater than about 1 g/cm$^3$ and the acoustic composite has a porosity between about 0.002% and about 50%.

In another aspect, the present invention provides an acoustic composite comprising a flow resistive substrate having a solid acoustic barrier material bonded to at least a portion of a major surface of the flow resistive substrate with a binder, wherein the acoustic barrier material has a density greater than about 1 g/cm$^3$ and wherein the barrier and the binder together cover between about 20% and about 99.998% of the major surface.

In yet another aspect, the present invention provides an acoustic composite comprising a flow resistive substrate comprising solid acoustic barrier material distributed within the substrate, wherein the acoustic barrier material has a density greater than about 1 g/cm$^3$ and the acoustic composite has a porosity between about 0.002% and about 50%.

As used herein, the term "flow resistive substrate" includes substrates having an air flow resistance of between about 10 and about 2000 rayls (as calculated according to ASTM C-522); the term "solid," when referring to acoustic barrier materials, includes materials that are highly viscous and that resist deformation and/or flow at room temperature (including, for example, glass or bitumen); and the term "porosity" means the measure of the area of all the open or void space (for example, holes) in the surface of the acoustic composite as measured as a percentage of the surface.

The acoustic composites of the invention provide acoustic absorption and transmission loss and they are relatively light weight.

DETAILED DESCRIPTION

Figure 1:
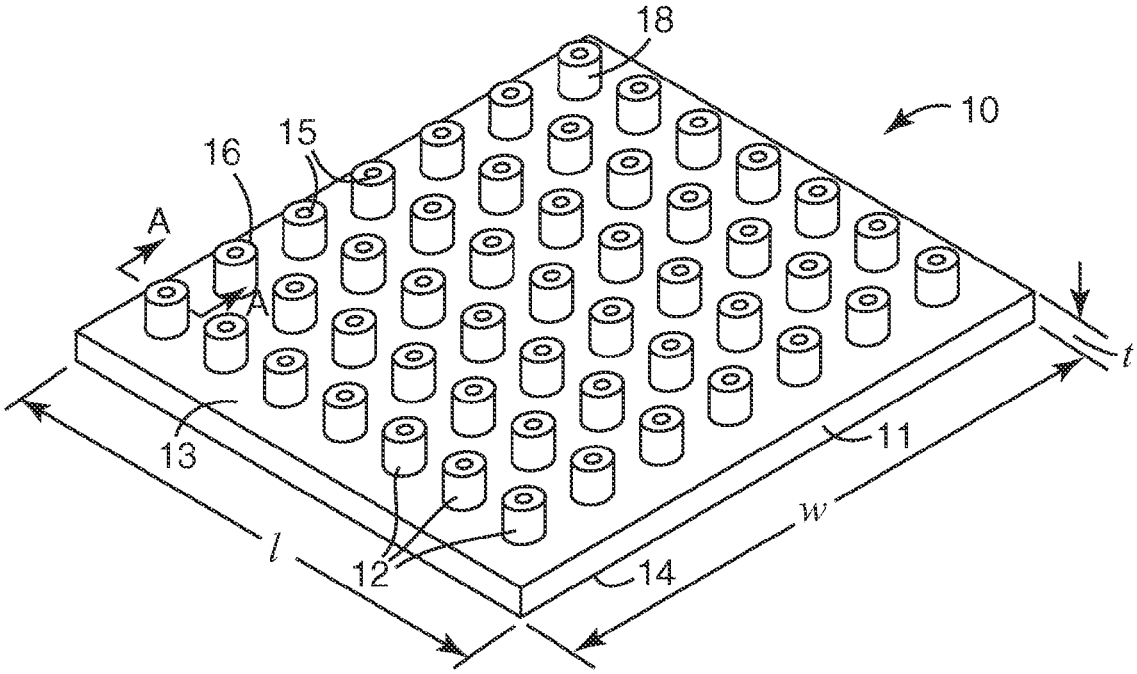
FIG. 1 depicts a structured microperforated film useful in the present invention.

The acoustic composites of the present invention comprise a flow resistive substrate. The flow resistive substrate typically has an air flow resistance of between about 10 and about 2000 rayls (preferably, between about 100 and about 2000 rayls; more preferably, between about 200 and about 1500 rayls). The flow resistive substrate can be any type of porous film or web. The flow resistive substrate can comprise, for example, thermoplastic polymers, thermosetting polymers, non-woven materials, woven fabrics, metal or plastic meshes, foams, foils, paper, or the like. In some embodiments, the flow resistive comprises holes or perforations sufficient to provide a desired porosity.

The flow resistive substrate can be a microperforated film. As used herein, the term "microperforated film" includes any flow resistive film having a plurality of microperforations (for example, holes or slots) defined in the film. The slot/hole shape and cross section can vary. The cross section can be, for example, circular, square, rectangular, hexagonal, and so forth. The maximum diameter (or maximum cross section dimension) is typically less than about 1016 μm (40 mils) (preferably, less than about 635 μm (25 mils); more preferably, less than about 381 μm (15 mils)).

Preferred microperforated films for use in the present invention are disclosed, for example, in U.S. Pat. No. 6,617,002 (Wood) and WO 2007/127890.

In one embodiment, the microperforated film comprises a polymeric film having a thickness and a plurality of microperforations defined in the polymeric film. The microperforations can have a narrowest diameter less than the film thickness and a widest diameter greater than the narrowest diameter. The narrowest diameter can, for example, range from about 254 μm (10 mils) to about 508 μm (20 mils) or less. The hole shape and cross section can vary. The cross-section of the holes can, for example, be circular, square, hexagonal and so forth. Preferably, the holes are tapered. The microperforated film can be relatively thin (for example, less than about 2032 μm (80 mils) or even less than about 508 μm (20 mils)) and flexible (for example, having a bending stiffness of about $10^6$ to about $10^7$ dyne-cm or less).

Microperforated films can be formed from many types of polymeric films, including for example, thermoset polymers such as polymers which are crosslinked or vulcanized.

An advantageous method of manufacturing a microperforated film involves embossing plastic materials. The plastic material can be formed from plastics such as polyolefins, polyesters, nylons, polyurethanes, polycarbonates, polysulfones, polystyrenes, or polyvinylchlorides. Optional additives can be added. Suitable additives include, but are not limited to, fillers, stabilizers, plasticizers, tackifiers, flow control agents, cure rate retarders, adhesion promoters (for example, silanes and titanates), adjuvants, impact modifiers, expandable microspheres, thermally conductive particles, electrically conductive particles, silica, glass, clay, talc, pigments, colorants, glass beads or bubbles, antioxidants, optical brighteners, antimicrobial agents, surfactants, fire retardants, and fluoropolymers. One or more of the above-described additives may be used to reduce the weight and/or cost of the resulting substantially planar film portion, adjust viscosity, or modify the thermal properties of the substantially planar film portion or confer a range of physical properties derived from the physical property activity of the additive including electrical, optical, density-related, liquid barrier or adhesive tack related properties. Copolymers and blends can also be used.

The embossable plastic material can be contacted with a tool having posts which are shaped and arranged to form holes in the plastic material. Embossable plastic material can be contacted with the tool using a number of different techniques such as, for example, embossing, including extrusion embossing, or compression molding. Embossable plastic material can be in the form of a molten extrudate which is brought in contact with the tooling, or in the form of a preformed film which is then heated and placed into contact with the tooling. Typically, the plastic material is first brought to an embossable state by heating the plastic material above its softening point, melting point or polymeric glass transition temperature. The embossable plastic material is then brought in contact with the post tool to which the embossable plastic generally conforms. The post tool generally includes a base surface from which the posts are suitably selected in consideration of the desired properties of the holes to be formed in the material. For example, the posts may have a height corresponding to the desired film thickness and have edges which taper from a widest diameter to a narrowest diameter which is less than the height of the post in order to provided tapered holes.

The plastic material can then be solidified to form a solidified plastic film having holes corresponding to the posts. The plastic material typically solidifies while in contact with the post tool. After solidifying, the solidified plastic film can then be removed from the post tool. In some instances, the solidified plastic film may undergo treatment to displace any skins that may be covering or partially covering holes.

Other methods for making microperforated films can also be utilized. For example, microperforations can be made in films using lasers, needle punches, male/female tools, pressurized fluids, or by other methods known in the art.

In another embodiment, the microperforated film comprises a structured film with tubular projections along at least one major outer surface of a substantially planar film portion of the film wherein one or more of the tubular projections comprise a hole. An exemplary structured film is shown in FIG. 1. Exemplary structured film 10 of FIG. 1 comprises a substantially planar film portion 11 and a plurality of tubular projections 12 extending above a first major surface 13 of substantially planar film portion 11. As described in more detail below, tubular projections 12 comprise a hole 15 extending from a first projection end 16 above first major surface 13 into or through substantially planar film portion 11, a projection sidewall 18 surrounding at least a portion of hole 15, and a projection length, L, extending a distance from first projection end 16 to first major surface 13.

The structured films comprise a substantially planar film portion such as substantially planar film portion 11 of exemplary structured film 10 shown in FIG. 1. The substantially planar film portion has a first major surface, a second major surface opposite the first major surface, and an average film portion thickness, t, extending from the first major surface to the second major surface. As used herein, the term "substantially planar film portion" is used to refer to the portion of structured films, which surround and separate the plurality of tubular projections from one another. As shown in FIGS. 1 and 2, the substantially planar film portion has a planar film portion having an average film portion thickness, t, substantially less than either the overall width w or length/of the structured film.

In the present invention, the "average film portion thickness" (designated t) of the substantially planar film portion is determined by measuring a thickness of the substantially planar film portion at numerous locations between adjacent tubular projections resulting in a total number of film portion thicknesses, x; and calculating the average portion thickness of the x film portion thicknesses. Typically, x is greater than about 3, and desirably ranges from about 3 to about 10. Desirably, each measurement is taken at a location approximately midway between adjacent tubular projections in order to minimize any effect on the measurement by the tubular projections.

The substantially planar film portion of the structured films has an average film portion thickness, which varies depending upon the particular end use of the structured film. Typically, the substantially planar film portion has an average film portion thickness of less than about 508 microns (μm) (20 mils.). In some embodiments, the substantially planar film portion has an average film portion thickness of from about 50.8 μm (2.0 mils.) to about 508 μm (20 mils.). In other embodiments, the substantially planar film portion has an average film portion thickness of from about 101.6 μm (4.0 mils.) to about 254 μm (10 mils.). In yet other embodiments, the substantially planar film portion has an average film portion thickness of from about 101.6 μm (4.0 mils.) to about 152.4 μm (6.0 mils.).

The substantially planar film portion of the structured films can comprise one or more polymeric materials. Suitable polymeric materials include, but are not limited to, polyolefins such as polypropylene and polyethylene; olefin copolymers (for example, copolymers with vinyl acetate); polyesters such as polyethylene terephthalate and polybutylene terephthalate; polyamide (Nylon-6 and Nylon-6,6); polyurethanes; polybutene; polylactic acids; polyvinyl alcohol; polyphenylene sulfide; polysulfone; polycarbonates; polystyrenes; liquid crystalline polymers; polyethylene-co-vinylacetate; polyacrylonitrile; cyclic polyolefins; or a combination thereof. In one exemplary embodiment, the substantially planar film portion comprises a polyolefin such as polypropylene, polyethylene, or a blend thereof.

The substantially planar film portion may further comprise one or more additives as described below. When present, the substantially planar film portion typically comprise at least 75 weight percent of any one of the above-described polymeric materials with up to about 25 weight percent of one or more additives. Desirably, the substantially planar film portion comprises at least 80 weight percent, more desirably at least 85 weight percent, at least 90 weight percent, at least 95 weight percent, and as much as 100 weight percent of any one of the above-described polymeric materials, wherein all weights are based on a total weight of the substantially planar film portion.

Various additives may be added to a polymer melt formed from one or more of the above-referenced polymers and extruded to incorporate the additive into the substantially planar film portion. Typically, the amount of additives is less than about 25 wt %, desirably, up to about 5.0 wt %, based on a total weight of the structured film. Suitable additives include, but are not limited to, additives such as those described above.

In one exemplary embodiment, the substantially planar film portion comprises a single layer of thermoformable material forming the first and second major surfaces and having the above-described average film portion thickness, wherein the thermoformable material comprises one or more of the above-mentioned polymers and optional additives. In a further exemplary embodiment of the structured film, the substantially planar film portion comprises a single layer of thermoformable material forming the first and second major surfaces and having the above-described average film portion thickness, wherein the first and second major surfaces are exposed (for example, are not covered) so as to be positionable and/or attachable to a desired substrate.

The structured films further comprise a plurality of tubular projections extending above the first major surface of the substantially planar film portion such as tubular projections 12 of exemplary structured film 10 shown in FIG. 1. The tubular projections are desirably formed from the same thermoformable composition used to form the above-described substantially planar film portion. In one desired embodiment, the substantially planar film portion and the plurality of tubular projections comprise a continuous, thermoformed structure formed from a single thermoformable composition comprising one or more of the above-mentioned polymers and optional additives.

In other desired embodiments, the substantially planar film portion and the plurality of tubular projections (i) comprise a continuous, thermoformed structure formed from a single thermoformable composition, and (ii) are free of post film-forming, projection-forming orientation. As used herein, the term "post film-forming, projection-forming orientation" is used to describe conventional processes used to form projections and/or openings in a film. Such conventional processes include, but are not limited to, a thermoforming step used to form projections in a previously solidified film structure (for example, not a molten film extrudate), a needle-punching step, or other film puncturing step.

The plurality of tubular projections may be uniformly distributed over the first major surface of the substantially planar film portion or randomly distributed over the first major surface. In some embodiments, the plurality of tubular projections are uniformly distributed over the first major surface (and optionally a corresponding portion of the second major surface) of the substantially planar film portion.

In one exemplary embodiment, the structured film comprises a plurality of tubular projections extending from the substantially planar film portion, wherein one or more tubular projections comprise (i) a hole extending from a first projection end above the first major surface into or through the substantially planar film portion, (ii) a projection sidewall surrounding at least a portion of the hole, the projection sidewall having an outer projection sidewall surface, an inner projection sidewall surface, and a projection sidewall thickness, and (iii) a projection length, L, extending a distance from the first projection end to the first major surface, wherein a ratio of the projection length, L, to the average film portion thickness, t, is at least about 3.5. In other embodiments, the ratio of the projection length, L, to the average film portion thickness, t, is at least about 4.0. In yet other embodiments, the ratio of the projection length, L, to the average film portion thickness, t, is from about 4.0 to about 10.0.

The tubular projections may have a substantially similar projection length that varies from film to film depending on the ultimate end use of a given structured film. Typically, the tubular projections have a projection length, L, ranging from about 25.4 μm (1 mil) to about 1.27 cm (500 mil), more typically, from about 50.8 μm (2 mil) to about 2.54 mm (100 mil), and even more typically, from about 508 μm (20 mil) to about 1.02 mm (40 mil).

The tubular projections may be further described in terms of their projection hole length, projection hole diameter, and projection sidewall thickness, each dimension of which may vary depending on the ultimate end use of a given structured film. Typically, the tubular projections have a projection hole length ranging from about 25.4 μm (1 mil) to about 1.32 cm (520 mil), more typically, from about 50.8 μm (2 mil) to about 2.79 mm (110 mil), and even more typically, from about 508 μm (20 mil) to about 1.14 mm (45 mil); a projection hole diameter ranging from about 25.4 μm (1 mil) to about 6.35 mm (250 mil), more typically, from about 25.4 μm (1 mil) to about 2.54 mm (100 mil), and even more typically, from about 25.4 μm (1 mil) to about 254 μm (10 mil); and a projection sidewall thickness ranging from about 25.4 μm (1 mil) to about 508 μm (20 mil), more typically, from about 25.4 μm (1 mil) to about 254 μm (10 mil), and even more typically, from about 25.4 μm (1 mil) to about 127 μm (5 mil).

The tubular projections may be further described in terms of a projection sidewall thickness in relation to the average film portion thickness, t, described above. In one exemplary embodiment, at least a portion of the tubular projections have a projection sidewall thickness equal to or greater than the average film portion thickness, t, of the substantially planar film portion.

As shown in FIGS. 2A-2F, the tubular projections may have a variety of shapes and cross-sectional configurations. In some embodiments, the tubular projections have a second projection end positioned below the second major surface of the substantially planar film portion. In these embodiments, the structured films comprise a plurality of tubular projections extending from the substantially planar film portion, wherein one or more tubular projections comprise (i) a hole extending from a first projection end above the first major surface into or through the substantially planar film portion, (ii) a projection sidewall surrounding at least a portion of the hole, the projection sidewall having an outer projection sidewall surface, an inner projection sidewall surface, and a projection sidewall thickness, and (iii) an end-to-end projection length extending a distance from the first projection end to a second projection end below the second major surface. For example, as shown in FIGS. 2A and 2C-2F, exemplary tubular projections 12 comprise a second end 17 positioned below second major surface 14 of substantially planar film portion 11.

In some embodiments in which one or more tubular projections have a second end below the second major surface of the substantially planar film portion of the structured film, one or more tubular projections desirably have an upper projection length extending a distance from the first projection end to the first major surface, wherein a ratio of the upper projection length (for example, projection length, L) to the average film portion thickness, t, is at least about 3.5. More desirably, the ratio of the upper projection length (for example, projection length, L) to the average film portion thickness, t, is from about 4.0 to about 10.0.

The tubular projections may have a projection sidewall thickness that varies along the projection length (for example, projection length, L, or an end-to-end projection length). As shown in FIGS. 2A-2F, exemplary tubular projections 12 may comprise a projection sidewall thickness that remains substantially constant along the projection length (see, for example, FIG. 2B) or a projection sidewall thickness that varies along the projection length (see, for example, FIGS. 2A and 2C-2F). In one exemplary embodiment, one or more tubular projections have a first wall thickness at a projection base located proximate the first major surface, a second wall thickness at the first projection end, and a third wall thickness at a projection midsection located between the projection base and the first projection end, wherein the first and second wall thicknesses are greater than the third wall thickness (see, for example, FIG. 2F). In another exemplary embodiment, one or more tubular projections have a first wall thickness at a projection base located proximate the first major surface, a second wall thickness at the first projection end, and a third wall thickness at a projection midsection located between the projection base and the first projection end, wherein the first and second wall thicknesses are less than the third wall thickness (see, for example, FIG. 2E).

Figure 2A:
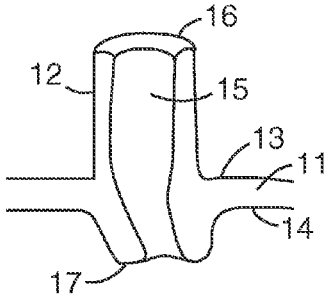
FIGS. 2A-2F depict possible cross-sectional configurations of exemplary tubular projections on a substantially planar film portion of the exemplary structured film of FIG. 1 along line A-A.
Figure 2B:
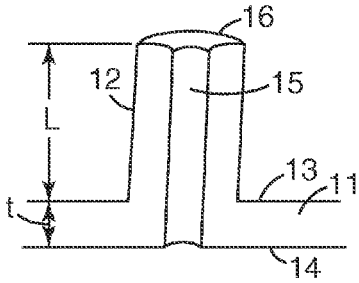
Figure 2C:
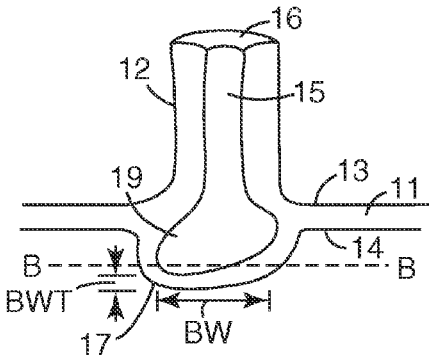
Figure 2D:
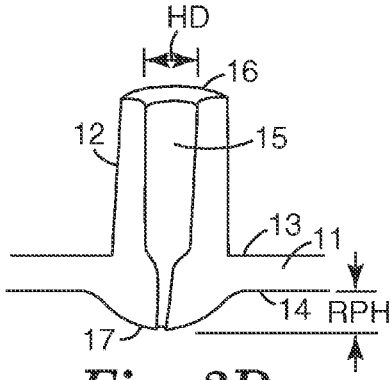
Figure 2E:
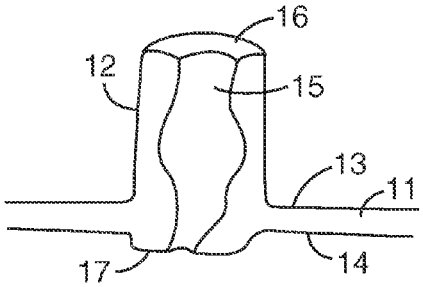
Figure 2F:
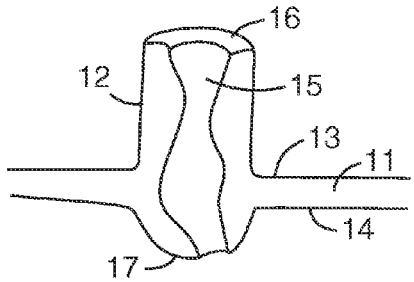

In further exemplary embodiments of the structured film, one or more tubular projections have a first cross-sectional area above the first major surface of the substantially planar film portion, a second cross-sectional area within the substantially planar film portion, and a third cross-sectional area below the second major surface of the substantially planar film portion, wherein the first cross-sectional area is less than the second and third cross-sectional areas (see, for example, FIG. 2C). In some embodiments, one or more tubular projections have a bubble portion (for example, bubble portion 19 shown in FIG. 2C) in fluid communication with the hole (for example, hole 15) extending through the tubular projection. In these embodiments, the bubble portion can be present (i) within the substantially planar film portion, (ii) below the second major surface, or (iii) both (i) and (ii) (see, for example, FIG. 2C). In some further embodiments, a lower portion of the bubble portion can be removed to provide an opening extending through the structured film from the first projection end to the second projection end. For example, a portion of bubble portion 19 along second end 17 of tubular projection 12 shown in FIG. 2C may be removed by cutting bubble portion 19 along dashed line B-B shown in FIG. 2C.

It should be noted that the tubular projections may have an outer tubular projection cross-sectional configuration that varies depending on the desired cross-sectional configuration and the type of tooling used to form the tubular projections. For example, the tubular projections may have an outer tubular projection cross-sectional shape in the form of a circle, an oval, a polygon, a square, a triangle, a hexagon, a multi-lobed shape, or any combination thereof.

In other exemplary embodiments of the structured films, one or more tubular projections have a hole (for example, hole 15) extending completely through the substantially planar film portion (with or without the need to remove a portion of the tubular projection as described above). As shown in FIGS. 2A-2B and 2D-2F, exemplary tubular projections 12 comprise hole 15 that extends along the projection length from first projection end 16 to second projection end 17. As shown in FIGS. 2A-2B and 2D-2F, a cross-sectional area of hole 15 can vary (see, for example, FIGS. 2A and 2D-2F) or remain substantially constant (see, for example, FIG. 2B) along the projection length from first projection end 16 to second projection end 17.

In one desired embodiment, the structured film comprises a plurality of tubular projections extending from the substantially planar film portion, wherein at least a portion of the tubular projections comprise (i) a hole extending from a first projection end above the first major surface through the substantially planar film portion to a second projection end below the substantially planar film portion providing an opening through the structured film, (ii) a projection sidewall surrounding at least a portion of the hole, the projection sidewall having an outer projection sidewall surface, an inner projection sidewall surface, and a projection sidewall thickness, and (iii) an end-to-end projection length extending a distance from the first projection end to the second projection end.

Typically, the tubular projections extend substantially perpendicular to the substantially planar film portion as shown in FIGS. 2A-2F; however, other orientations of tubular projections relative to the substantially planar film portion are within the scope of the present invention.

The tubular projections may be present along one or both major surfaces of the substantially planar film portion of the structured film at a tubular projection density that varies depending on the desired tubular projection density, and the end use of the structured film. In one exemplary embodiment, the tubular projections are present along one or both major surfaces of the substantially planar film portion of the structured film at a tubular projection density of up to about 1000 projections/$cm^2$ of outer surface area of the substantially planar film portion. Typically, the tubular projections are present along one or both major surfaces of the substantially planar film portion of the structured film at a tubular projection density of from about 10 projections/$cm^2$ to about 300 projections/$cm^2$ of outer surface area of the substantially planar film portion.

In some embodiments, the structured film is liquid impermeable (for example, water impermeable) and vapor permeable.

A method of making a structured film useful in the present invention comprises extruding a sheet of molten extrudate from a die; bringing the molten extrudate into contact with a tooling so as to cause a portion of the molten extrudate to enter into a plurality of holes located on a tooling outer surface resulting in (i) an air pressure differential between a higher air pressure within one or more holes of the tooling and a lower air pressure on an outer surface of the molten extrudate opposite the tooling, and (ii) formation of a plurality of projections along a molten extrudate surface; allowing air within the one or more holes of the tooling to move in a direction toward the outer surface of the molten extrudate opposite the tooling so as to (i) reduce the air pressure differential and (ii) form a projection hole within one or more of the plurality of projections; and cooling the molten extrudate and plurality of projections to form a structured film comprising a substantially planar film portion having first and second major surfaces and a plurality of tubular projections extending from at least the first major surface.

In the above exemplary method of making a structured film, the bringing step may comprise nipping the molten extrudate between the tooling and a nip roll, wherein the tooling comprises a tooling roll. Further, the allowing step may comprise rotating the tooling roll and nip roll so that the nip roll is not positioned over the outer surface of the molten extrudate opposite the tooling. In any of the exemplary methods of making a structured film, one or more process parameters may be adjusted so that the allowing step results in the projection hole within one or more of the tubular projections to extend from a first projection end into or through the substantially planar film portion. Process parameters that can be adjusted include, but are not limited to, an extrudate composition, an extrudate temperature, a tooling temperature, a tooling speed, a tooling hole depth, a molten extrudate sheet thickness, or any combination thereof.

In other exemplary methods of making a structured film, one or more process parameters may be adjusted so that the allowing step results in a projection hole within one or more tubular projections that extends from a first projection end into or through the substantially planar film portion so as to form a bubble portion in fluid communication with the projection hole. In this embodiment, the bubble portion may be positioned (i) within the substantially planar film portion, (ii) below the second major surface of the substantially planar film portion, or (iii) both (i) and (ii). Process parameters that can be adjusted to form a bubble portion include, but are not limited to, an extrudate composition, an extrudate temperature, a tooling temperature, a tooling speed, a tooling hole depth, a molten extrudate sheet thickness, or any combination thereof.

In some embodiments in which a bubble portion is formed within one or more tubular projections, the method of making a structured film may further comprise opening the bubble portion so as to provide an opening extending completely through one or more of the tubular projections. The step of opening the bubble portion may comprise removing a tip of the bubble portion (for example, cutting a tip from a lower surface of the bubble portion), puncturing the bubble portion (for example, with a needle or other sharp object), pressurizing the projection hole, heating or flame-treating the tip of the bubble portion, or any combination of the above-described opening steps.

In other exemplary methods of making a structured film, one or more process parameters are adjusted so that the allowing step results in a projection hole within one or more tubular projections that extends from a first projection end through the substantially planar film portion so as to provide an opening extending through one or more tubular projections (for example, without the need for the above-described opening step). Again, process parameters that can be adjusted to form an opening extending completely through one or more tubular projections include, but are not limited to, an extrudate composition, an extrudate temperature, a tooling temperature, a tooling speed, a tooling hole depth, a molten extrudate sheet thickness, or any combination thereof.

In yet further exemplary methods of making a structured film, one or more of the above-mentioned process parameters may be adjusted so that the allowing step results in one or more tubular projections extending from above the first major surface of the structured film to below the second major surface of the structured film. In this embodiment, the method may further comprise, after the cooling step, removing at least a portion of thermoformed material below the second outer surface of the structured film, if necessary, so as to provide an opening extending completely through one or more tubular projections of the structured film from a first projection end above the first major surface to a second projection end below the second major surface. In this embodiment, the method may also optional comprise a step wherein substantially all of the thermoformed material located below the second major surface of the structured film is removed so that the structured film comprises a plurality of tubular projections along only a first major surface of the structured film.

In one desired embodiment, the method of making a structured film comprises the steps of extruding molten extrudate from a die into a nip formed between a rotating tooling roll and a rotating nip roll; forcing a portion of the molten extrudate into a plurality of holes located in the rotating tooling roll resulting in (i) an air pressure differential between a higher air pressure within one or more holes of the rotating tooling roll and a lower air pressure on an outer surface of the molten extrudate opposite the rotating tooling roll, and (ii) formation of a plurality of projections along a molten extrudate surface; rotating the tooling and nip rolls so as to allow air within the one or more holes of the rotating tooling roll to move in a direction toward the outer surface of the molten extrudate opposite the rotating tooling roll so as to form a projection hole within one or more of the plurality of projections; and cooling the molten extrudate and plurality of projections to a temperature below a softening temperature of the molten extrudate and plurality of projections. This exemplary method may be performed using an apparatus such as exemplary apparatus 30 shown in FIG. 3.

Figure 3:
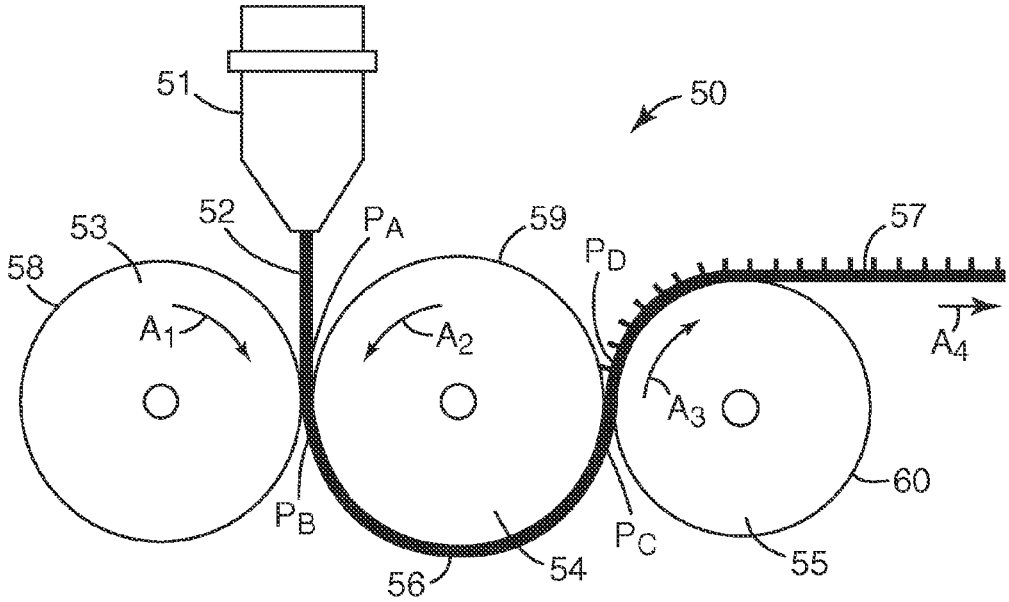
FIG. 3 depicts a schematic diagram of an exemplary apparatus suitable for forming a structured film of the present invention.

As shown in FIG. 3, exemplary apparatus 30 comprises a die assembly 31 from which a molten extrudate 32 exits. Molten extrudate 32 proceeds to point $P_A$ where molten extrudate 32 passes between nip roll 33 rotating in a first direction as noted by arrow $A_1$ and tooling roll 34 rotating in an opposite direction as noted by arrow $A_2$. At point $P_A$, nip roll 33 forces a portion of molten extrudate 32 into holes (not shown) within an outer surface 39 of tooling roll 34. Outer surface 38 of nip roll 33 is typically smooth and is optionally coated with a release material (for example, a silicone or PTFE). As molten extrudate 32 fills holes (not shown) in outer surface 39 of tooling roll 34 due to force by outer surface 38 of nip roll 33, air pressure within individual holes (not shown) increases, forming an air pressure differential between a higher air pressure within the individual holes (not shown) and a lower air pressure on outer surface 36 of molten extrudate 32 opposite tooling roll 34.

As nip roll 33 and tooling roll 34 rotate, outer surface 38 of nip roll 33 is displaced from outer surface 36 of molten extrudate 32, which allows air within individual holes (not shown) to move through molten extrudate within the individual holes (not shown) toward outer surface 36 of molten extrudate 32 (that is, toward the lower air pressure). At about point $P_B$, molten extrudate within individual holes (not shown) of outer surface 39 of tooling roll 34 begins to harden. It is believed that molten extrudate adjacent outer surface 39 of tooling roll 34 and individual hole sidewall surfaces hardens prior to a central portion of molten extrudate in a central location of individual holes. As molten extrudate 32 moves from point $P_B$ to point $P_C$ along outer surface 39 of tooling roll 34, the above-described air movement causes a hole to develop within the molten extrudate, which quickly moves toward outer surface 36 of molten extrudate 32. As described above, the air movement may result in (i) a hole extending into or through a substantially planar film portion of molten extrudate 32, (ii) a bubble formed within and/or below the substantially planar film portion of molten extrudate 32, (iii) a hole extending completely through the substantially planar film portion of molten extrudate 32, (iv) a second projection end below a second major surface of the substantially planar film portion of molten extrudate 32, or (v) any combination of (i) to (iv).

At about point $P_C$, molten extrudate 32 and tubular projections 12 formed therein are substantially hardened. As molten extrudate 32 with tubular projections 12 therein moves along outer surface 39 of tooling roll 34, outer surface 36 of substantially hardened molten extrudate 32 comes into contact with outer surface 40 of take-off roll 33 rotating in a direction as noted by arrow $A_3$. At point $P_D$, substantially hardened molten extrudate 32 separates from outer surface 39 of tooling roll 34 and proceeds in a direction as noted by arrow $A_4$ along outer surface 40 of take-off roll 33 resulting in structured film 37 having tubular projections 12 therein.

The disclosed exemplary methods of making structured films of the present invention may be used to form structured films comprising any of the above-mentioned polymeric materials and optional additives. Typically, the thermoforming method step involves melt extruding a film-forming thermoformable material at a melt extrusion temperature ranging from about 120° C. to about 370° C.

The disclosed methods of making structured films of the present invention can produce structured films having relatively large hole depth/hole diameter ratios. For example, in one exemplary embodiment, the disclosed methods are capable of producing structured films wherein at least a portion of the tubular projections have a projection hole length to projection hole diameter ratio of at least about 1:1. In other exemplary embodiments, the disclosed methods are capable of producing structured films wherein at least a portion of the tubular projections have a projection hole length to projection hole diameter ratio of at least about 3:1, and as much as 5:1 and higher.

Further, the ability to provide a relatively thin substantially planar film portion allows for lower basis weight films, which can be advantageous in weight conscious applications. A lower basis weight for the structured films of the present invention also translates into lower raw materials usage and lower manufacturing costs. The disclosed methods are capable of producing structured films wherein at least a portion of the tubular projections have a projection hole length to average film portion thickness ratio of at least about 1.1:1, and in some embodiments, a projection hole length to average film portion thickness ratio of at least about 5:1, and in some embodiments, a projection hole length to average film portion thickness ratio of at least about 10:1 or higher.

The disclosed methods of making structured films may utilize a tooling so as to produce tubular projections having a projection length, L, as described above. For example, a suitable tooling may comprise a plurality of holes in an outer surface of the tooling, wherein the holes have an average tooling hole depth of up to about 1.5 cm (588 mil). In other embodiments, a suitable tooling may comprise holes have an average tooling hole depth of from about 27.9 μm (1.1 mil) to about 3.0 mm (117 mil), and in other embodiments, an average tooling hole depth of from about 747 μm (29.4 mil) to about 1.5 mm (58.8 mil).

Suitable toolings may also have holes therein, wherein the holes have one or more hole cross-sectional shapes so as to form tubular projections having a desired cross-sectional shape. Suitable hole cross-sectional shapes include, but are not limited to, a circle, an oval, a polygon, a square, a triangle, a hexagon, a multi-lobed shape, or any combination thereof.

In addition, suitable toolings may have any desired density of holes along an outer surface of the tooling (for example, in outer surface 59 of tooling roll 54). For example, a tooling may have a hole density of up to about 1000 holes/cm$^2$ of outer surface area of the tooling. Typically, the tooling has a hole density ranging from about 10 holes/cm$^2$ to about 300 holes/cm$^2$ of outer surface area of the tooling.

The acoustic composites of the invention comprise acoustic barrier material. The acoustic barrier material shifts frequency absorption into the lower frequency range and also provides increased transmission loss. In some embodiments, the flow resistive substrate has an acoustic barrier material bonded to at least a portion of at least one of its major surfaces. In some embodiments, acoustic barrier material is bonded to both major surfaces of the flow resistive substrate. As used herein, the term "bonded" includes chemical and mechanical means for acoustically coupling (that is, joining and securing) the acoustic barrier material to the substrate. In other embodiments, the acoustic barrier material is distributed within the flow resistive substrate (that is, the acoustic barrier material is "inside" the film).

Acoustic barrier materials for use in the acoustic composites of the invention have a density greater than about 1 g/cm$^3$ (preferably greater than about 2 g/cm$^3$; more preferably greater than about 4 g/cm$^3$). Suitable acoustic barrier materials include, for example, metals, metal alloys, metal oxides, glass, silicates, minerals, sulfides, clay, bitumen, calcium carbonate, barium sulfate, loaded polymers, and the like.

The acoustic barrier material can be in any useful form. For example, the acoustic barrier can a particle, granule, or bead. In acoustic composites in which the acoustic barrier material is on the surface of the flow resistive substrate, the acoustic barrier material can also, for example, be a continuous layer of mass comprising holes (that is, a "contiguous layer") such as a metal foil comprising holes. Preferably, the acoustic barrier material is selected from the group consisting of metal particles, glass particles, and combinations thereof; more preferably, the acoustic barrier is a steel particle or a glass particle.

In one embodiment of the invention, the acoustic barrier material is a layer comprising a polymer such as, for example, ethylene propylene diene M-class rubber (EPDM), ethylene vinyl acetate (EVA), or olefin-based polymers filled with particles having a higher density than the polymer. Suitable filler particles can comprise any of the materials described above as suitable acoustic barrier materials. The filler particles have a density in greater than about 1 g/cm$^3$ (preferably, greater than about 2 g/cm$^3$; more preferably, greater than about 4 g/cm$^3$). Examples of preferred filler particles include calcium carbonate, barium sulfate, and other mineral-based particles with a density greater than about 1 g/cm$^3$. The density of the polymer with the filler particles is typically from about 0.15 lb/ft$^2$ to about 1.5 lb/ft$^2$.

An acoustic barrier material layer (including, but not limited to, polymeric acoustic barrier material layers containing filler particles) can comprise holes or perforations. The holes or perforations can be in any shape but are preferably relatively circular in shape. Preferably, they have a diameter from about 3 mm to about 20 mm and are about 10 to about 300 times larger in diameter than the planar microperforated film described above. The porosity, or percent open area, of this acoustic barrier material layer typically ranges from about 10% to about 60%. By adding holes or perforations to the acoustic barrier material layer, its basis weight can be reduced, for example, by about 10% to about 50%.

Acoustic composites known as a "leaky barrier" can be made by bonding (for example, laminating) the above-described acoustic barrier material layer comprising holes or perforations to a flow resistive substrate. By varying the porosity of the acoustic barrier material layer, the overall porosity of the acoustic composite can be varied. The porosity of the acoustic composite is therefore a function of the porosity of the acoustic barrier material layer multiplied by the porosity of the flow resistive substrate. Preferably, the porosity of the leaky barrier acoustic composite is about 0.06% to about 50% (more preferably, about 0.06% to about 30%; even more preferably, about 0.06% to about 10%).

When designing an acoustic composite for a particular application, one of skill in the art can choose appropriate acoustic barrier materials using known principles of Mass Law.

The acoustic barrier material can be bonded to the flow resistive substrate using any suitable binder. Examples of suitable binders include thermoplastic resins such as ethylene/acrylic acid copolymer, polyethylene, and poly(ethylmethylacrylic) acid; acrylic pressure-sensitive adhesives which cure to a nontacky state; and thermosetting binders which have a tacky state such as epoxy resins, phenolics, and polyurethanes. Preferably, the binder is an epoxy binder.

The binder is typically prepared from a curable binder precursor. The curable binder precursor can comprise organic thermosetting and/or thermoplastic material, although this is not a requirement. Preferably, the binder precursor is capable of being cured by radiation energy or thermal energy. Sources of radiation energy include electron beam energy, ultraviolet light, visible light, and laser light. If ultraviolet or visible light is utilized a photoinitiator may be utilized.

Useful thermosetting curable binder precursors include, for example, phenolic resins, polyester resins, copolyester resins, polyurethane resins, polyamide resins, and mixtures thereof. Useful temperature-activated thermosetting binder precursors include formaldehyde-containing resins such as phenol formaldehyde, novolac phenolics (preferably those with added crosslinking agents), phenoplasts, and aminoplasts; unsaturated polyester resins; vinyl ester resins; alkyl resins, allyl resins; furan resins; epoxies; polyurethanes; cyanate esters; and polyimides. Useful binder precursors that are capable of being cured by radiation energy include acrylated urethanes, acrylated epoxies, ethylenically unsaturated compounds, aminoplast derivatives having pendant acrylate groups, isocyanate derivatives having at least one pendant acrylate group, vinyl ethers, epoxy resins, and combinations thereof.

Useful thermoplastic curable binder precursors include polyolefin resins such as polyethylene and polypropylene; polyester and copolyester resins; vinyl resins such as polyvinylchloride and vinyl chloride-vinyl acetate copolymers; polyvinyl butyral; cellulose acetate; acrylic resins including polyacrylic and acrylic copolymers such as acrylonitrile-styrene copolymers; and polyamides, co-polyamides, and combinations thereof.

The acoustic barrier material can be mixed with a binder (or binder precursor) and then added to a surface of the flow resistive substrate. Alternatively, a binder (or binder precursor) can first be coated onto the flow resistive substrate and then the acoustic material can be added to the coated substrate. In either case, the binder can be patterned in any desired pattern (for example, a dot or stripe pattern). A pattern can be obtained, for example, by applying the binder (or binder precursor) through stencil holes or a screen. Binder (or binder precursor) can also be coated onto the flow resistive substrate using rotary screen printing, roll coating, die coating, mechanical placement of agglomerates, or by any means known in the art. Typically, the acoustic barrier material and the binder together cover between about 20% and about 99.98% of the major surface of the flow resistive substrate (preferably between about 20% and about 99.5%).

In embodiments in which the acoustic barrier material is distributed within the flow resistive substrate, polymeric material comprising the acoustic barrier material can be extruded, calendared and/or pressed. The method of U.S. Pat. No. 4,486,200 (Heyer et al.) can also be used for making acoustic composites with barrier material distributed with the flow resistive substrate. The acoustic composites of the invention typically have a porosity between about 0.002% and about 50% (preferably, between about 0.5% and about 50%; more preferably between about 0.5% and about 15%). The porosity of the acoustic composite is a function of both the porosity of the (naked) flow resistive substrate and the coverage of the binder and acoustic barrier material.

One of skill in the art will appreciate that a number of variables must be considered when designing an acoustic composite or acoustic composite system. Key variables that can affect acoustic absorption and transmission loss include the mass of the acoustic film and the resistive flow of the perforated film. The resistive flow or porosity of the film has the greatest effect on the absorption characteristics of an acoustic system. The mass of the system has the greatest effect on the transmission loss. In general as the hole diameters/porosity increases (and thereby the resistive flow decreases), the absorption curve will shift to higher frequency absorption and broaden in the frequency range. As the hole diameters/porosity decreases (and thereby the resistive flow increases), the absorption curve will shift to lower frequencies and a narrower range in frequency absorption. Transmission loss is directly affected by Mass Law. Transmission loss increases as the mass of the film increases. Mass will also affect the absorption by shifting the absorption curve to lower frequencies when the mass of the system is increased.

The materials selected when designing an acoustic composite or acoustic composite system can also affect non-acoustic properties. Depending upon the materials chosen, the acoustic composites of the invention can provide one or more of the following properties: radio frequency, heat transfer, heat reflection, conductivity (electrical, thermo, or light), non-conductivity (electrical, thermo, or light), electromagnetic waves, light reflection or transmission, flame retardance, flexibility, or stretchability.

The acoustic composites of the invention can comprise one or more optional layers. Suitable additional layers include, but are not limited to, a fabric layer (for example, woven, non-woven, and knitted fabrics); a paper layer; a color-containing layer (for example, a print layer); a sub-micron fiber layer such as those disclosed in U.S. patent application Ser. No. 60/728,230; foams; layers of particles; foil layers; films; decorative fabric layers; membranes (that is, films with controlled permeability, such as dialysis membranes, reverse osmosis membranes, etc.); netting; mesh; wiring and tubing networks; or a combination thereof.

In embodiments of the acoustic composites of the invention in which the flow resistive substrate comprises tubular projections, the one or more additional layers may be present (i) on and/or in contact with tubular projection ends extending above the first major surface of the substantially planar film portion of the structured film (for example, first projection ends), (ii) on and/or in contact with tubular projection ends extending below the second major surface of the substantially planar film portion (for example, second projection ends), (iii) on and/or in contact with the second major surface of the substantially planar film portion (for example, second major surface), (iv) both (i) and (ii), or (v) both (i) and (iii).

The acoustic composites of the invention can be disposed near a reflecting surface to define a cavity therebetween. The cavity can be purely an air gap or it can comprise, for example, a non-woven material. The depth of the cavity will typically depend upon the frequency range in which the acoustic composite will be utilized. Increasing the cavity depth, for example, shifts the frequency curve for absorption to lower frequencies. In general, though, the depth of the cavity will range from about 0.3 cm (⅛ inch) to about 15 cm (6 inches) (preferably, about 0.3 cm (⅛ inch) to about 2.5 cm (1 inch)).

The acoustic composite can be disposed near the reflecting surface in a number of ways. For example, the acoustic composite can be attached to a structure which includes the reflecting surface. In this case, the acoustic composite can be attached on its edges and/or its interior. The acoustic composite can also be hung, similar to a drape, from a structure near the reflecting surface. A spacing structure (for example, a honeycomb structure) can be placed between the acoustic composite and the reflecting surface.

The reflecting surface can be for example, a surface of an automobile (for example, an automobile hood, dashboard, or underbelly surface), a wall or ceiling or a building, a window, or the like. The reflecting surface could also be a metal plate or a backing film.

For some applications such as, for example, automotive under carpet applications, the acoustic composite can be provided as part of a layered construction comprising a layer of carpet, the acoustic composite, and a non-woven layer. Preferably, the non-woven layer comprises shoddy (for example, fibrous material made from fabric scraps or shredded rags). The layered construction can further comprise a metal plate. Often the metal plate is an integral part of the automobile. Such layered constructions provide good acoustic performance in a relatively light weight system.

The acoustic composites (and systems containing the acoustic composites) of the invention can be used in a variety of applications. They are particularly useful in acoustical applications such as sound absorbing and sound barrier applications. In one exemplary embodiment, a method of using the acoustic composite comprises a method for providing acoustic absorption and transmission loss in an area, wherein the method comprises surrounding at least a portion of the area with an acoustic composite of the invention. The acoustic composite can provide about 50% or more acoustic absorption for frequencies ranging from about 500 Hz (preferably, from about 400 Hz; more preferably from about 250 Hz; most preferably, from about 100 Hz) to about 4000 Hz. The acoustic composite can also provide acoustic transmission loss ranging from about 3 dB to about 30 dB for frequencies ranging from about 500 Hz (preferably, from about 400 Hz; more preferably from about 250 Hz; most preferably, from about 100 Hz) to about 4000 Hz.

In some embodiments, an entire area may be surrounded by the acoustic composite alone or in combination with one or more optional layers as described above.

The step of surrounding an area may comprise positioning the acoustic composite over at least a portion of the area. In some embodiments, the surrounding step may comprise positioning the acoustic composite or composite system over at least a portion of the area. The surrounding step may further comprise the step of attaching the acoustic composite or composite system to a substrate. Any of the above-described attachment methods may be used to attach the acoustic composite or composite system to a given substrate. Suitable substrates may include, but are not limited to, a wall of a building, a ceiling of a building, a building material for forming a wall or ceiling of a building, a metal sheet, a glass substrate, a door, a window, a vehicle component, a machinery component, an electronic device (for example, printers, hard drives, etc.), or an appliance component.

In other embodiments of the present invention, a method of using the acoustic composite comprises a method for providing acoustic absorption and transmission loss between a sound-generating object and an area. In this exemplary method, the method may comprise providing an acoustic composite between the sound-generating object and the area. The acoustic composite can provide about 50% or more acoustic absorption for frequencies ranging from about 500 Hz (preferably, from about 400 Hz; more preferably from about 250 Hz; most preferably, from about 100 Hz) to about 4000 Hz. The acoustic composite can also provide acoustic transmission loss ranging from about 3 dB to about 30 dB for frequencies ranging from about 500 Hz (preferably, from about 400 Hz; more preferably from about 250 Hz; most preferably, from about 100 Hz) to about 4000 Hz.

The sound-generating object may be any object that generates sound including, but not limited to, a vehicle motor, a piece of machinery, an appliance motor or other moving component, an electronic device such as a television, an animal, etc.

The area in either of the above exemplary methods of using an acoustic composite of the invention may be any area in which sound is to be absorbed and/or restricted from. Suitable areas may include, but are not limited to, an interior of a room; an interior of or other location in a vehicle; a piece of machinery; an appliance; a separate sound reduced area of an office or industrial area; a sound recording or reproduction area; the interior of a theatre or concert hall; an anechoic, analytical or experimental room or chamber where sound would be detrimental; and earmuffs or ear covering for isolating and/or protecting ears from noise.

The acoustic composites of the present invention may also be used as a resistive membrane layer in a carpet system. In this embodiment, one or more layers of fabric are attached to each side of the acoustic composite to form a laminate.

EXAMPLES

Objects and advantages of this invention are further illustrated by the following examples, but the particular materials and amounts thereof recited in these examples, as well as other conditions and details, should not be construed to unduly limit this invention.

Examples 1 and 2

Micro-Perforated Film with SS Beads (Example 1) or Glass Beads (Example 2)

Figure 4:
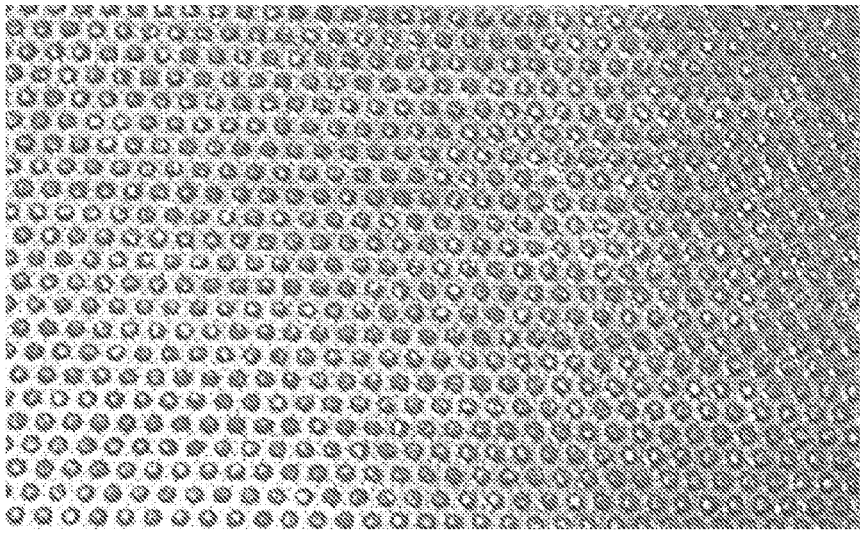
FIG. 4 is a photograph of an acoustic composite of the invention according to Example 1.
Figure 5:
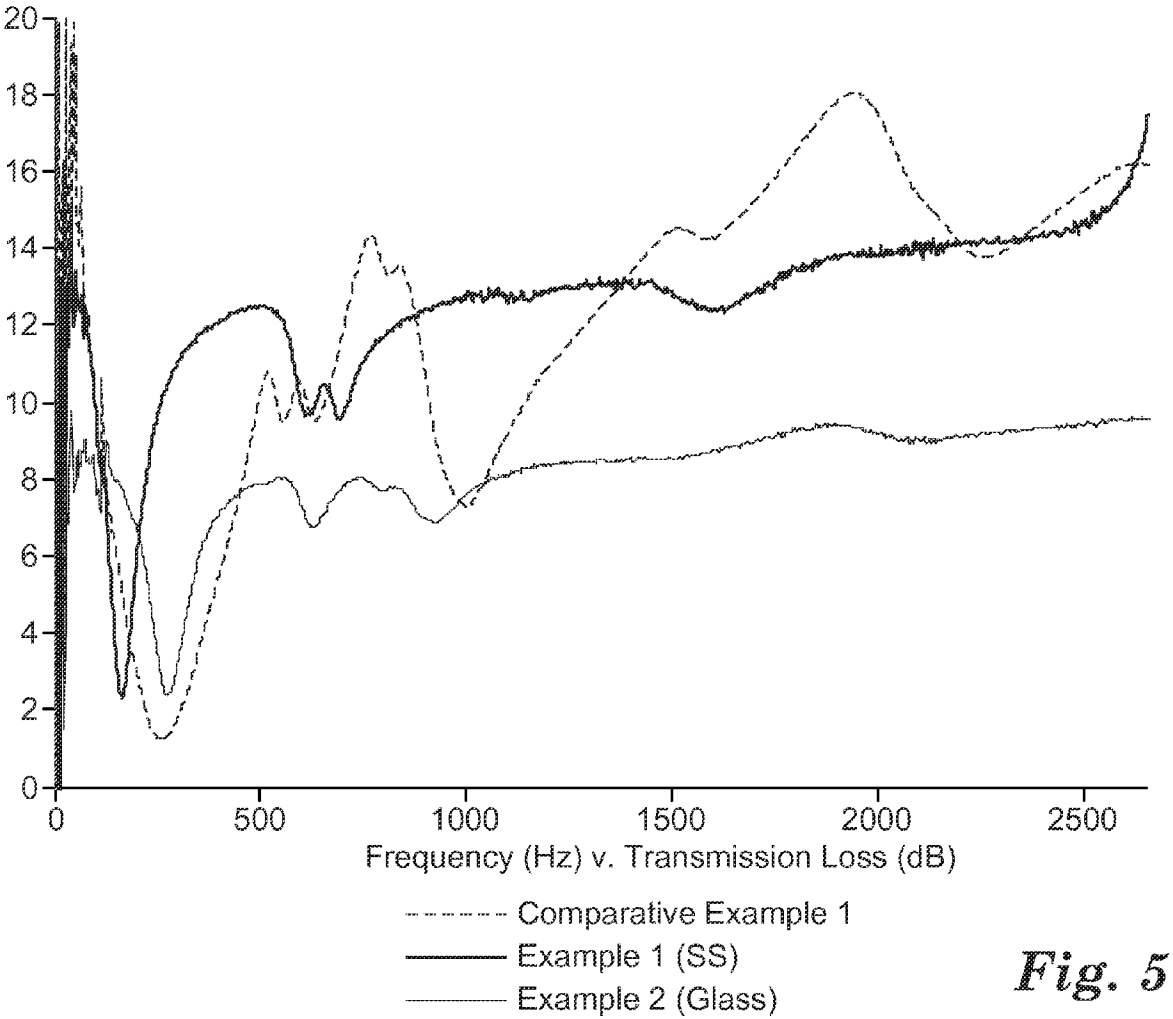
FIG. 5 graphically depicts transmission loss data from an acoustic composite of the invention according to Examples 1 and 2.
Figure 6:
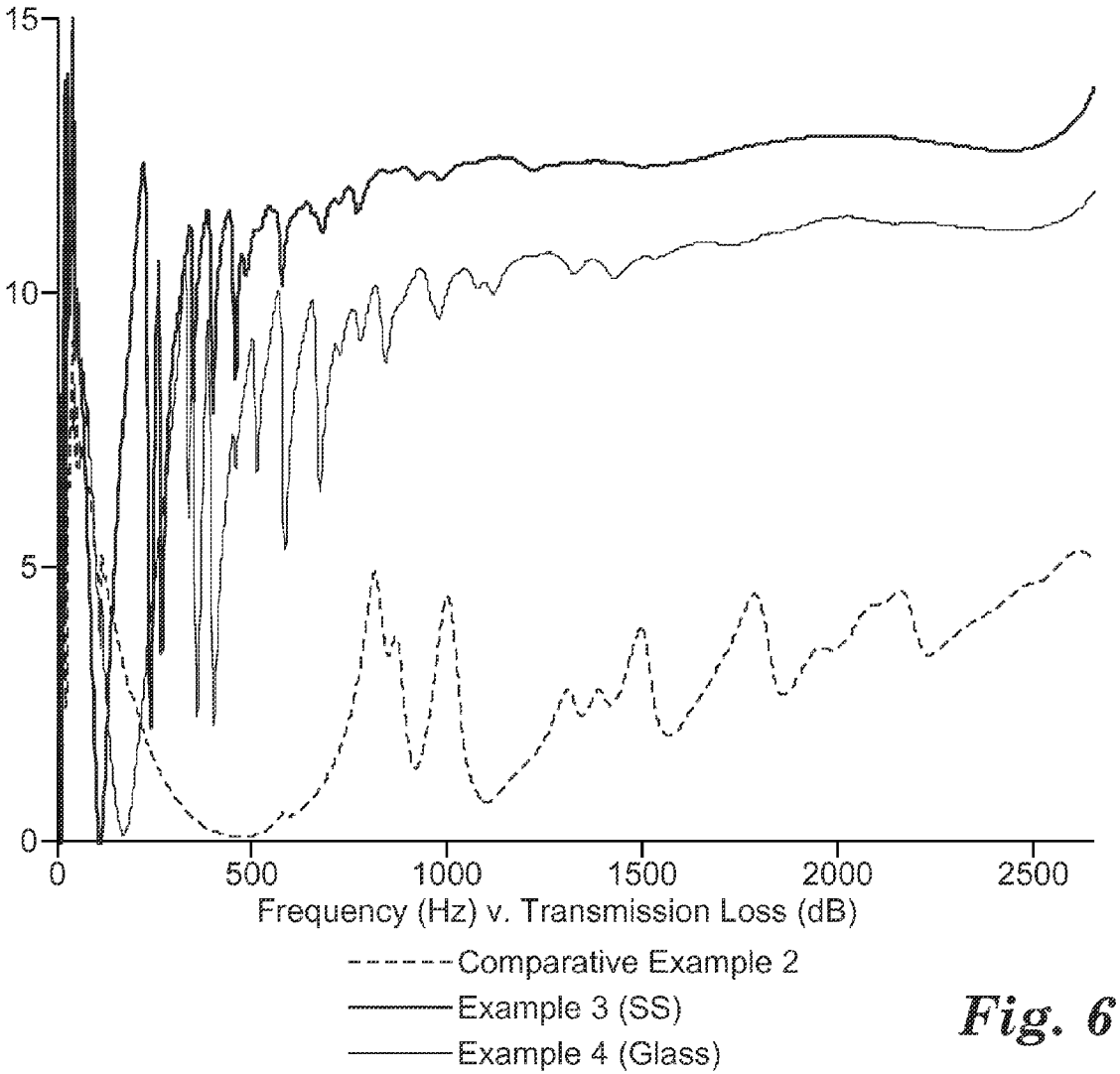
FIG. 6 graphically depicts transmission loss data from an acoustic composite of the invention according to Examples 3 and 4.
Figure 7:
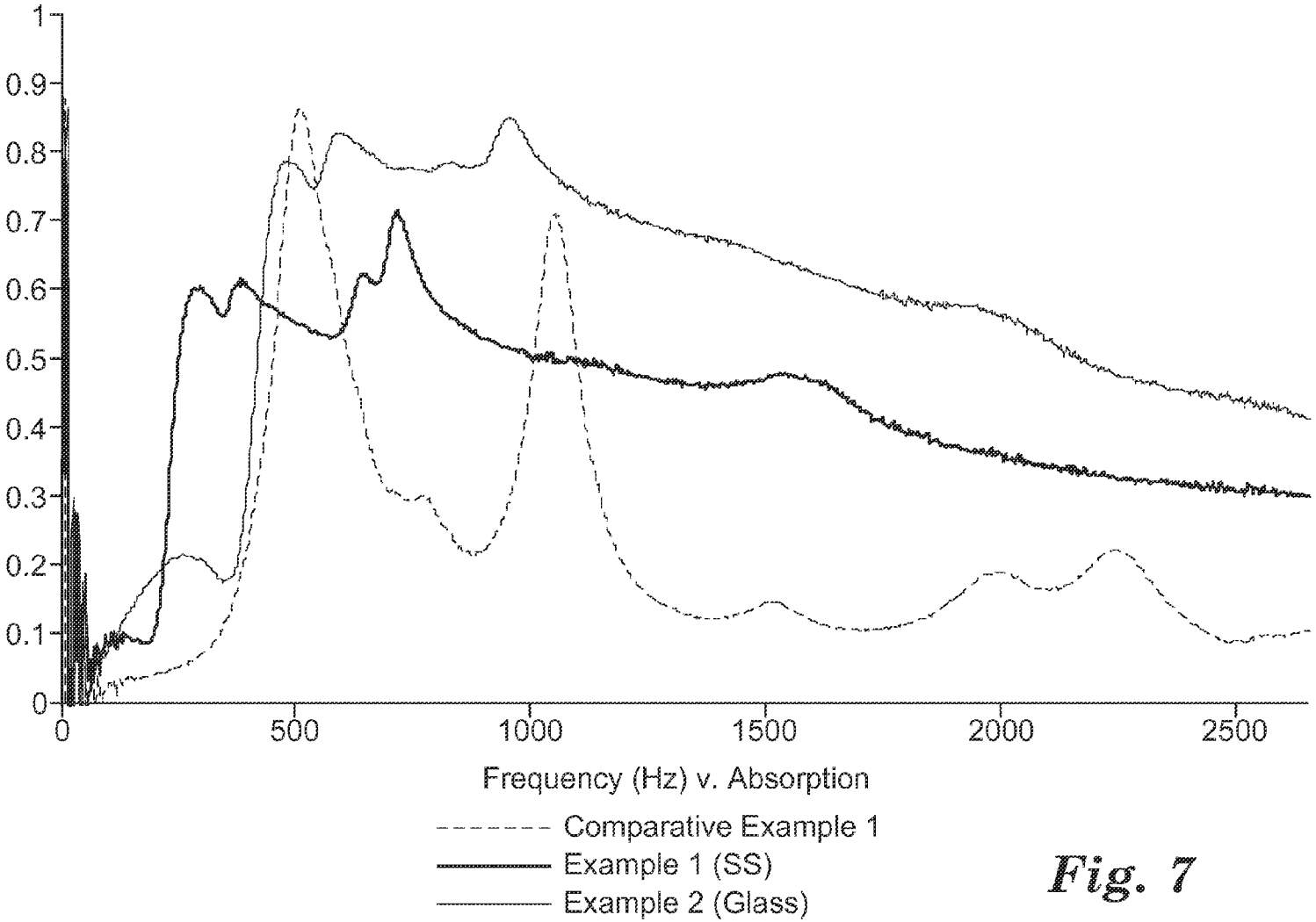
FIG. 7 graphically depicts absorption data from an acoustic composite of the invention according to Examples 1 and 2.
Figure 8:
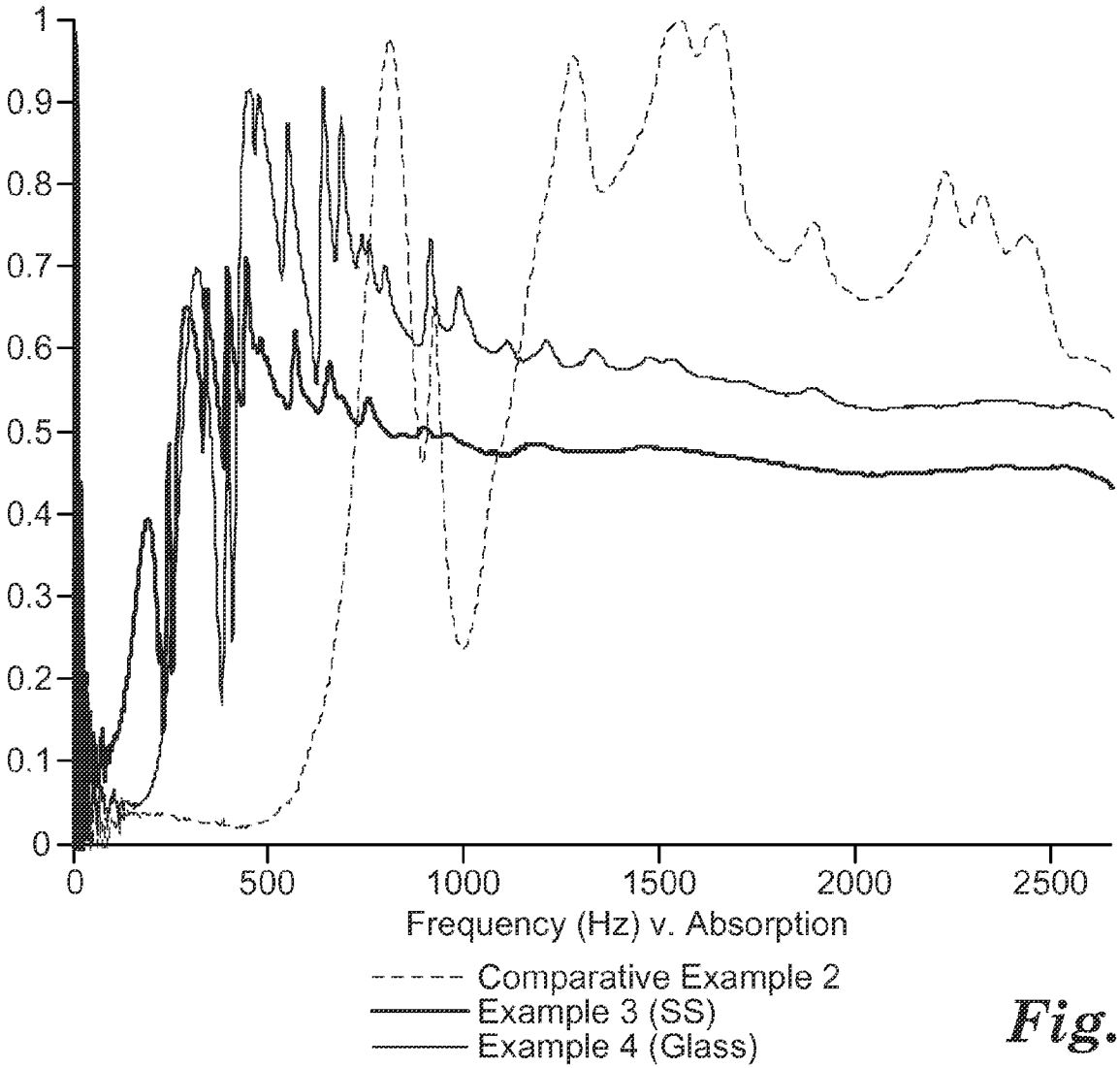
FIG. 8 graphically depicts absorption data from an acoustic composite of the invention according to Examples 3 and 4.
Figure 9:
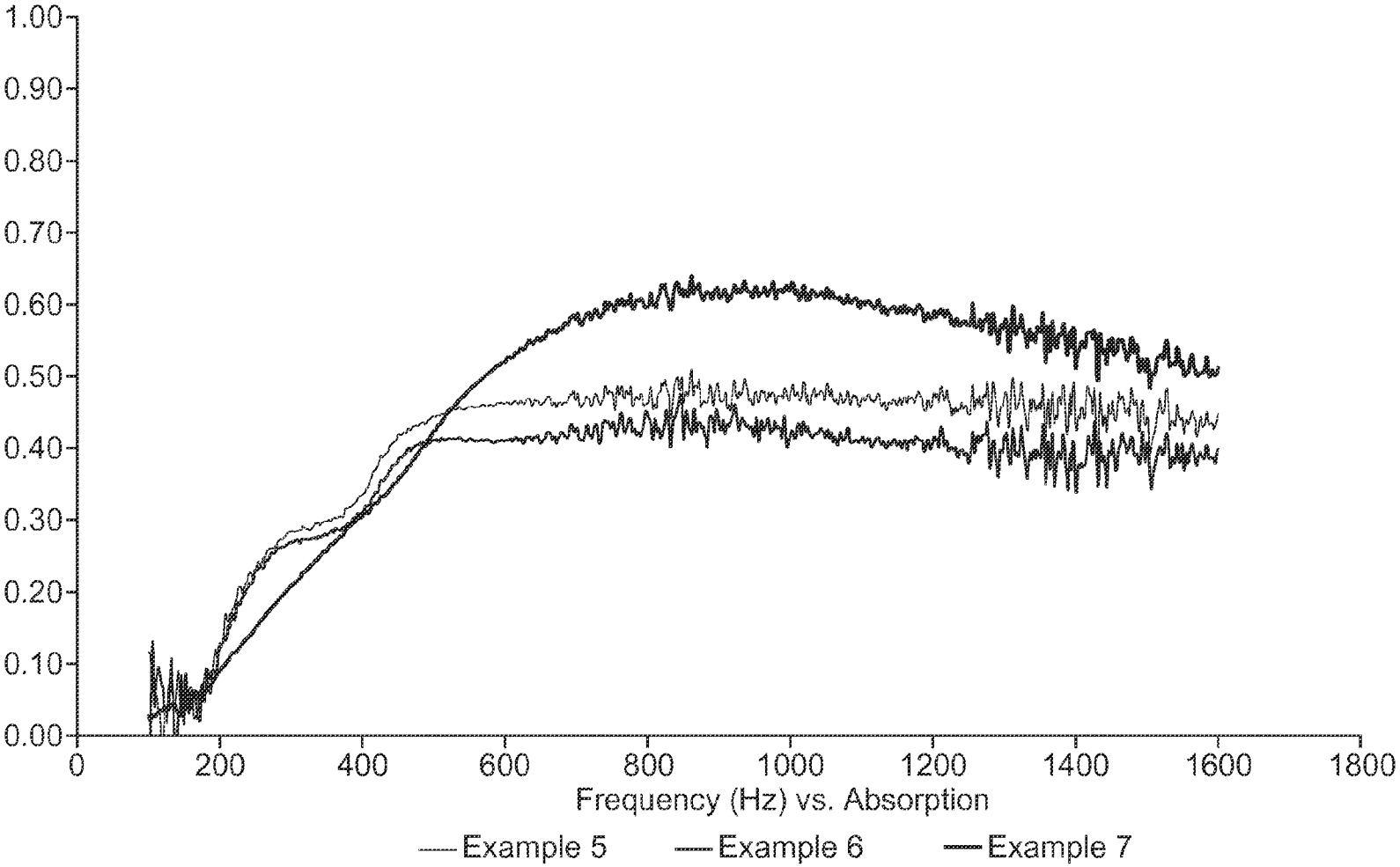
FIG. 9 graphically depicts absorption data from an acoustic composite of the invention according to Examples 5-7.
Figure 10:
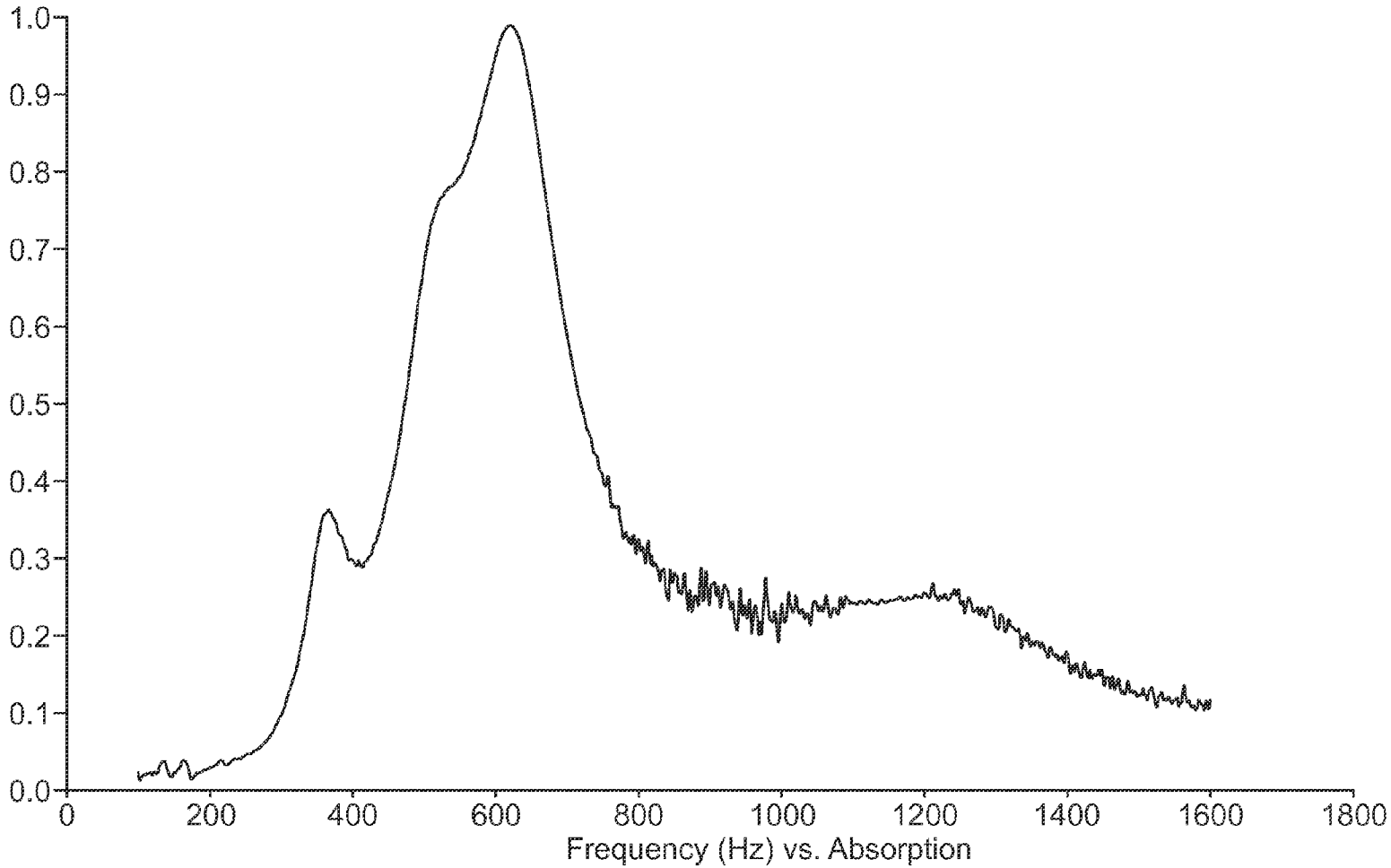
FIG. 10 graphically depicts absorption data from an acoustic composite of the invention according to Example 8.

Materials:

1. Micro-perforated film with a thickness of 20 mil (or 0.51 mm) with punched holes having an average diameter of 5 mil (or 0.13 mm) from micro-perforation (780 holes/inch$^3$ (121 holes/cm$^3$)) was made essentially as described in U.S. Pat. No. 6,617,002 (Wood).
2. Epoxy resin (Scotch-Weld, DP 100 Fast Cure, available from 3M Company (St. Paul, Minn.)) 50 cc per pack
3. Beads, as filler: Stainless steel beads, diameter: 8 mil (or 0.2 mm), glass beads: 3 mil (or 0.075 mm).
4. Stainless steel screen with the thickness of 30 mil (0.76 mm), with hole diameter 1.63 mm, hole density 74 hole/sq in.
5. Acetone, solvent grade Procedure:

Microperforated film as a substrate was primed with 1% solution of epoxy resin (Scotch-Weld DP 100) solution in acetone. Then the film was dried at room temperature in the air vented hood for 4 hours. The primed film 17.8 cm (7 inches) by 17.8 cm (7 inches) was laid on a flat surface, then covered by the metal screen, which was mold release treated (Rocket Release, E302, Stoner, Inc. (Quarryville, Pa.)). An epoxy resin mixture weighing 18 g was mixed and 140 g of stainless steel beads (or 80 g of glass beads) was mixed into the epoxy resin. Quickly after mixing, the resulting mixture was poured over the metal screen and the extra was removed using a scraper. Immediately after the mixture was poured, the metal screen was removed from the substrate. The film with metal/epoxy printed on was further cured at room temperature for 2 hours before any further processing. The resulting acoustic composite of Example 1 is shown in FIG. 4 at 5× magnification.

Glass beads based: Weight gain: 422 g/m$^2$

Steel beads based: Weight gain: 1899 g/m$^2$

Examples 3 and 4

Resistive Non-woven Scrim with SS Beads (Example 3) or Glass Beads (Example 4)

Materials:

1. Non-woven scrim, polypropylene 1.5 oz/SqYd SMS spunbond from Kimberly-Clark. Airflow resistance is 17 rayls.
2. Epoxy resin (Scotch-Weld, DP 100 Fast Cure) 50 cc per pack
3. Beads, as filler: Stainless steel beads, diameter: 8 mil (or 0.2 mm), glass beads: 3 mil (or 0.075 mm).
4. Stainless steel screen with the thickness of 30 mil (0.76 mm), with hole diameter 1.63 mm, hole density 74 hole/sq in.

Procedure:

Resistive scrim samples 17.8 cm (7 inches) by 17.8 cm (7 inches) were laid on a flat surface, then covered by the metal screen, which was mold release treated (Rocket Release, E302). An epoxy resin mixture weighing 18 g was mixed and 140 g of stainless steel beads (or 80 g of glass beads) was mixed into the epoxy resin. Quickly after mixing, the resulting mixture was poured over the metal screen and the extra was removed using a scraper. Immediately after the mixture was poured, the metal screen was removed from the substrate. The film with metal/epoxy printed on was further cured at room temperature for 2 hours before any further processing.

Glass beads based: Weight gain: 791 g/m$^2$

Steel beads based: Weight gain: 1793 g/m$^2$

Examples 5-7

Micro-Perforated Film Laminated with EPDM Rubber

Materials:

1. Micro-Perforated Film with thickness of 0.51 mm with holes having an average diameter of 0.13 mm made as described in U.S. Pat. No. 6,617,002.
2. Sheet of EPDM (Ethylene Propylene Diene Monomer) rubber with a thickness of 3.4 mm and a basis weight of approximately 4200-4300 g/m$^2$.
3. Pressure sensitive spray adhesive, 3M™ Super 77™ or 3M Hi-Strength 90.
4. Stainless Steel Sheets (0.305 m×0.610 m×0.006 m)
5. Steel Block Weights (9.07 kg)

Procedure:

A 120 mm diameter circle was cut from the EPDM rubber sheet and also from the Mirco-Perforated Film. Then 12.7 mm for Ex. 5 (19.05 mm for Ex. 6, 6.35 mm for Ex. 7) diameter holes were punched out of the EPDM sheet using a steel rule die. The number of holes ranged from 12 holes for Ex. 5 (6 holes for Ex. 6, 40 holes for Ex. 7) and were symmetrically distributed around the center and within a 100 mm diameter area of the 120 mm EPDM rubber circle. The resulting porosity for Ex. 5 was approximately 0.07%. The resulting porosity for example 6 was approximately 0.08%. The resulting porosity for example 7 was approximately 0.06%. Then the EPDM circle with holes was sprayed with the spray adhesive. Quickly, the micro-perforated film was placed on top of the EPDM rubber layer. The micro-perforated film and EPDM rubber with pressure sensitive adhesive was then placed between two stainless steel sheets then weight (approximately 9.07 kg) was placed on the top stainless steel sheet for more than 5 hours.

Example 8

Micro-Perforated Film Laminated with Tape

Materials:

1. Micro-Perforated Film with thickness of 0.51 mm with holes having an average diameter of 0.13 mm made as described in U.S. Pat. No. 6,617,002.
2. Box sealing tape with pressure sensitive adhesive on one side, 3M™ Scotch™ 355.

Procedure:

A 120 mm diameter circle was cut from the Mirco-Perforated Film. Then approximately 3-4 sheets of the box sealing tape was applied on the Micro-Perforated Film to cover a majority of the Micro-Perforated Film area, approximately 99.998% of the area was covered. The pressure sensitive side was placed against the Micro-Perforated Film surface. The approximately 0.002% porosity was placed towards the center of the innermost 100 mm diameter circle area.

Acoustic Testing

Acoustic absorption tests were conducted on the samples of Examples 1-8 and on the microperforated film and resistive scrim samples without acoustic barrier material (Comparative Examples 1 and 2). A Bruel & Kjaer (Norcross, Ga.) Model 6205 impedance tube tester using a 64 mm square tube was utilized. Tests were run per ASTM Document #5285. Impedance Tube test results are shown in FIGS. 5-10.

Various modifications and alterations to this invention will become apparent to those skilled in the art without departing from the scope and spirit of this invention. It should be understood that this invention is not intended to be unduly limited by the illustrative embodiments and examples set forth herein and that such examples and embodiments are presented by way of example only with the scope of the invention intended to be limited only by the claims set forth herein as follows.

We claim:

1. An acoustic composite comprising:

a flow resistive substrate having a solid acoustic barrier material bonded to at least a portion of a major surface of the flow resistive substrate; wherein the acoustic barrier material has a density greater than about 1 g/cm$^3$ and the acoustic composite has a porosity between about 0.002% and about 50%.

2. The acoustic composite of claim 1, wherein the flow resistive substrate having a solid acoustic barrier material is bonded to at least a portion of a major surface of the flow resistive substrate with a binder; further wherein the acoustic barrier material has a density greater than about 1 g/cm$^3$ and additionally wherein the barrier and the binder together cover between about 20% and about 99.998% of the major surface.

3. The acoustic composite of claim 2, wherein the barrier and the binder together cover between about 20% and about 99.5% of the major surface.

4. The acoustic composite of claim 1, wherein the flow resistive substrate comprises a non-woven or a microperforated film.

5. The acoustic composite of claim 4, wherein the flow resistive substrate is a polymeric microperforated film comprising a plurality of microperforations, wherein the microperforations each have a narrowest diameter less than the film thickness and a widest diameter greater than the narrowest diameter.

6. The acoustic composite of claim 4, wherein the flow resistive substrate is a microperforated film comprising:

a substantially planar film portion having a first major surface, a second major surface, and an average film portion thickness; and a plurality of tubular projections extending from the substantially planar film portion, wherein one or more tubular projections comprise a hole.

7. The acoustic composite of claim 6, wherein one or more of the tubular projections comprise:

(i) a hole extending from a first projection end above the first major surface into or through the substantially planar film portion, (ii) a projection sidewall surrounding at least a portion of the hole, the projection sidewall having an outer projection sidewall surface, an inner projection sidewall surface, and a projection sidewall thickness, and (iii) a projection length extending a distance from the first projection end to the first major surface, wherein a ratio of the projection length to the average film portion thickness is at least about 3.5.

8. The acoustic composite of claim 6 wherein the substantially planar film portion comprises a thermoformable material and one or more of the tubular projections comprise:

(i) a hole extending from a first projection end above the first major surface into or through the substantially planar film portion, (ii) a projection sidewall surrounding at least a portion of the hole, the projection sidewall comprising the thermoformable material and having an outer projection sidewall surface, an inner projection sidewall surface, and a projection sidewall thickness, and (iii) an end-to-end projection length extending a distance from the first projection end to a second projection end below the second major surface.

9. The acoustic composite of claim 6 wherein the substantially planar film portion comprises a thermoformable material and wherein at least a portion of the tubular projections comprises:

(i) a hole extending from a first projection end above the first major surface into or through the substantially planar film portion to a second projection end below the substantially planar film portion providing an opening through the structured film, (ii) a projection sidewall surrounding at least a portion of the hole, the projection sidewall comprising the thermoformable material and having an outer projection sidewall surface, an inner projection sidewall surface, and a projection sidewall thickness, and (iii) an end-to-end projection length extending a distance from the first projection end to the second projection end.

10. The acoustic composite of claim 6, wherein the flow resistive substrate is liquid impermeable and vapor permeable.

11. The acoustic composite of claim 1, wherein the acoustic barrier material comprises particles selected from the group consisting of metal particles, glass particles, and combinations thereof.

12. The acoustic composite of claim 1, wherein the acoustic barrier material is bonded to the flow resistive substrate with a discontinuous coating of binder.

13. The acoustic composite of claim 1, wherein the acoustic barrier material is a contiguous layer comprising holes.

14. The acoustic composite of claim 1, wherein the acoustic barrier material comprises filler particles.

15. The acoustic composite of claim 1, further comprising one or more layers comprising a woven or non-woven material or foam.

16. An acoustic composite system comprising:

(a) a flow resistive substrate having a solid acoustic barrier material bonded to at least a portion of a major surface of the flow resistive substrate; wherein the solid acoustic barrier material ahs a density greater than about 1 g/cm$^3$ and the acoustic composite has a porosity between about 0.002% and about 50%;

(b) a layer of carpet; and (c) a non-woven layer.

17. An acoustic composite system comprising:

(a) a flow resistive substrate having a solid acoustic barrier material bonded to at least a portion of a major surface of the flow resistive substrate; wherein the acoustic barrier material has a density greater than about 1 g/cm$^3$ and the acoustic composite has a porosity between about 0.002% and about 50%; and (b) a reflecting surface;

wherein the acoustic composite is disposed near the reflecting surface such that the acoustic composite and the reflecting surface define a cavity therebetween.

18. A method for providing acoustic absorption and transmission loss in an area comprising surrounding at least a portion of the area with an acoustic composite comprised of a flow resistive substrate having a solid acoustic barrier material bonded to at least a portion of a major surface of the flow resistive substrate; wherein the acoustic barrier material has a density greater than about 1 g/cm$^3$ and the acoustic composite has a porosity between about 0.002% and about 50%, wherein for frequencies ranging from about 100 Hz to about 4000 Hz, the acoustic composite provides acoustic transmission loss ranging from about 3 dB to about 30 dB, and at least about 50% acoustic absorption.

19. A method for providing acoustic absorption and transmission loss between a sound-generating object and an area comprising providing an acoustic composite comprised of a flow resistive substrate having a solid acoustic barrier material bonded to at least a portion of a major surface of the flow resistive substrate; wherein the acoustic barrier material has a density greater than about 1 g/cm$^3$ and the acoustic composite has a porosity between about 0.002% and about 50%, wherein for frequencies ranging from about 500 Hz to about 4000 Hz, the acoustic composite provides acoustic transmission loss ranging from about 3 dB to about 30 dB, and at least about 50% acoustic absorption.

20. An acoustic composite comprising a flow resistive substrate comprising solid acoustic barrier material distributed within the substrate; wherein the acoustic barrier material has a density greater than about 1 g/cm$^3$ and the acoustic composite has a porosity between about 0.002% and about 50%.

* * * * *